United States Patent [19]

Creutz, deceased et al.

[11] 4,170,526

[45] Oct. 9, 1979

[54] ELECTROPLATING BATH AND PROCESS

[75] Inventors: Hans G. Creutz, deceased, late of Yale, Mich., by Katharina A. Creutz, administratrix; Roy W. Herr, Troy, Mich.

[73] Assignee: Oxy Metal Industries Corporation, Warren, Mich.

[21] Appl. No.: 869,967

[22] Filed: Jan. 16, 1978

[51] Int. Cl.[2] ..... C25D 3/22

[52] U.S. Cl. ..... 204/55 R

[58] Field of Search ..... 204/55 R, 43 Z, 114; 106/1.29

[56] References Cited

U.S. PATENT DOCUMENTS

| | | | |
|---|---|---|---|
| 3,729,394 | 4/1973 | Hsu et al. | 204/55 R |
| 3,822,194 | 7/1974 | Rushmere | 204/55 R |
| 3,884,774 | 5/1975 | Kessler | 204/55 Y |
| 3,920,528 | 11/1975 | Voss et al. | 204/55 R |
| 3,928,149 | 12/1975 | Steeg | 204/55 R |

FOREIGN PATENT DOCUMENTS

| | | | |
|---|---|---|---|
| 1263445 | 3/1968 | Fed. Rep. of Germany | 204/55 R |

*Primary Examiner*—G. L. Kaplan

*Attorney, Agent, or Firm*—Richard P. Mueller; Arthur E. Kluegel

[57] ABSTRACT

A non-cyanide acid or substantially neutral zinc electroplating bath and zinc plating process employing said bath which contains an effective amount of a brightening and leveling agent, and which comprises a bath soluble quaternary compound formed by the reaction of heterocyclics with an alkylating agent selected from the group consisting of dialkyl sulfates, alkyl alkane sulfonates and alkyl arene sulfonates. The versatility and effectiveness of the brightening and leveling agent of this invention enables improved processing of a wide variety of articles, thereby requiring only minimal amounts of the additive agent to produce brilliant and smooth zinc deposits.

6 Claims, No Drawings

ELECTROPLATING BATH AND PROCESS

BACKGROUND OF THE INVENTION

Zinc plating processes are in wide-spread commercial use for applying a corrosion resistant, and in some instances, a decorative plating upon a variety of substrates, and more particularly upon ferrous articles composed of iron and steel. A considerable number of additive agents have heretofore been used or proposed for use in zinc electrolytes for improving the brightness and leveling characteristics of the deposit. However, because of environmental and other considerations, increased commercial emphasis has recently been placed on so-called non-cyanide zinc plating solutions of the acid and alkaline types. Brightening and leveling agents employed in such non-cyanide plating solutions in accordance with prior art practice, while effective to produce relatively bright zinc platings, have presented problems in some instances due to the relatively high concentrations required in the aqueous solutions to achieve the desired results. Such aqueous zinc plating solutions have also been categorized as being very selective with respect to the work pieces being processed, thereby requiring the maintenance of an inventory of alternative brightening agents and solutions to accommodate processing of a variety of different work pieces.

The problems and disadvantages associated with noncyanide type zinc plating solutions are overcome in accordance with the present invention by which a zinc electroplating bath is provided incorporating an additive agent which is particularly effective in producing brilliant zinc platings when employed in only relatively small amounts, which further enhances the leveling characteristics of the plating bath, and which also have versatility in plating of a broad range of different articles.

SUMMARY OF THE INVENTION

The benefits and advantages of the present invention are achieved by a non-cyanide acidic or substantially neutral zinc electroplating bath composition adapted to operate over a pH range of from about 2 to about 9, which contains a controlled effective amount of a brightening and leveling agent comprising a quaternary formed by the reaction of a heterocyclic with an alkylating agent selected from the group consisting of dialkyl sulfates, alkyl alkane sulfonates, and alkyl arene sulfonates or mixtures of these quaternaries. The additive agent is further defined by the formula:

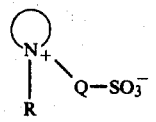

Wherein:

$Q = R_1, R_2O$ $R = CH_3, C_2H_5$ $R_1 = CH_3, C_2H_5, CH_3C_6H_4$ $R_2 = CH_3, C_2H_5$

The heterocyclic compound as set forth in the foregoing structural formula may comprise pyridine, isoquinoline, quinoline, pyrimidine, phenazine, imidazole, imidazoline, pyrrole, pyrazole, pyrazine, purine, acridine, and soluble substituted derivatives of the named compounds and mixtures thereof.

The brightener and leveling additive agent can be effectively employed in amounts as low as about ½ mg/l to concentrations as high as approximately 5 g/l with concentrations of from about 2 mg/l up to about 100 mg/l being satisfactory in most instances. The additive agent is incorporated in aqueous solutions incorporating conventional zinc salts in further combination with inert salts to thereby increase bath conductivity in accordance with known prior art techniques. When operating the electroplating bath at a pH above about 6.8, an organic chelating agent is advantageously employed to prevent zinc metal from precipitating from the bath.

In accordance with the process aspects of the present invention, brilliant, smooth and adherent zinc platings are attained on metal substrates by subjecting the articles to an electroplating bath incorporating the aforementioned brightening and leveling agent at temperatures ranging from approximately 60° F. to about 140° F. and at current densities broadly ranging from about 5 ASF up to about 200 ASF.

Additional benefits and advantages of the present invention will become apparent upon a reading of the description of the preferred embodiments taken in conjunction with the specific examples provided.

DESCRIPTION OF THE PREFERRED EMBODIMENTS

The improved zinc electroplating bath of the present invention comprises an aqueous, non-cyanide acid or substantially neutral zinc electroplating bath of a pH ranging from about 2.0 up to about 9.0 and incorporating an effective amount of a specific quaternary of mixture of heterocyclic alkylated sulfate or sulfonate quaternaries in combination with appropriate concentrations of other conventional constituents employed in acid or substantially neutral non-cyanide zinc electroplating baths. The zinc ion, in accordance with conventional practice, is introduced into the aqueous solution by an aqueous soluble zinc salt, such as zinc sulfate, zinc chloride, zinc fluoroborate, zinc acetate or the like as well as mixtures thereof to provide a concentration of zinc ranging from about 5 up to about 105 g/l, with concentrations of zinc ranging from about 10 to approximately 70 g/l being preferred.

In addition to the aqueous soluble zinc salt, the bath may further contain, in accordance with conventional practice, inert salts for improving the conductivity of the bath and for further enhancing the appearance of the zinc plate deposit. Such inert salts may include sodium chloride, potassium chloride, ammonium chloride, ammonium sulfate, magnesium chloride, magnesium sulfate or the like. Additionally, any one of a variety of wetting agents in accordance with conventional practice can also be satisfactorily employed with concentrations thereof typically ranging from about 0.1 up to about 30 g/l. Maintenance of the appropriate pH of the electroplating bath is facilitated by incorporating buffering agents of the types conventionally used in commercial practice such as boric acid or its salts, acetic acid on its salts, and like compounds which are typically present in concentrations of from about 0.5 up to about 100 g/l.

In addition to the foregoing conventional bath constituents, the improved bright zinc electroplating bath further incorporates a controlled effective amount of a brightening and leveling agent comprising a quaternary formed by the reaction of a heterocyclic with an alkylating agent selected from the group consisting of dialkyl sulfates, alkyl alkane sulfonates, alkyl arene sulfonates and mixtures thereof. The unique additive agent is exemplified by the structural formula:

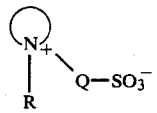

Wherein:

$Q = R_1, R_2O$ $R = CH_3, C_2H_5$ $R_1 = CH_3, C_2H_5, CH_3C_6H_4$ $R_2 = CH_3, C_2H_5$

The heterocyclic component of the additive agent as herein disclosed and as set forth in the subjoined claims can comprise a heterocyclic compound selected from the group consisting of pyridine, isoquinoline, quinoline, pyrimidine, phenazine, imidazole, imidazoline, pyrrole, pyrazole, pyrazine, purine, acridine, and soluble substituted derivatives of the named compounds and mixtures thereof.

Of the various quaternized heterocyclic compounds encompassed by the aforementioned structural formula, the following compounds are typical: isoquinoline diethyl sulfate quaternary, quinaldine diethyl sulfate quaternary, propylisonicotinate dipropyl sulfate quaternary, pyrimidine diethyl sulfate quaternary, phenazine dimethyl sulfate quaternary, pyridine-N-methyl tosylate quaternary, pyridine dimethyl sulfate quaternary, nicotinamide dimethyl sulfate quaternary, imidazole dimethyl sulfate quaternary, and the like. The quaternized heterocyclic compounds of the present invention are prepared by known techniques as disclosed in "Preparative Organic Chemistry" 4th Edition by Hilgetag and Martini published 1972 by John Wiley & Sons pages 497 through 502 and "Methoden Der Organischen Chemie" by Houben-Weyl published 1958 by George Thieme Verlag pages 591 through 601. Additional descriptions of the preparation of these types of quarternized heterocyclic compounds are found in "Advances in Heterocyclic Chemistry," Vol. 3, by A. R. Katritzky, published 1964 by Academic Press, page 2 and 9 through 13, "The Organic Chemistry of SulfurTetracovalent Sulfur Compounds," by Chester Merle Suter, published 1944 by John Wiley and Sons Inc., pages 530 and 569; and "Reagents for Organic Synthesis," by Louis and Mary Fieser, published 1967 by John Wiley and Sons, Inc., pages 294 and 295.

The unique additive agent employed in the zinc plating bath of the present invention is extremely potent and powerful in its brightening characteristics enabling the use of the additive in concentrations as low as about ½ mg/l in some instances while amounts as high as about 5.0 g/l can be used. Generally concentrations ranging from about 2.0 mg/l to about 100 mg/l are preferred in most instances. The alkyl sulfonate or alkyl sulfate group comprising the quaternizing agent contributes to the extreme effectiveness of the additive agent as a brightener and attempts to substitute these groups with alternative quaternary groups has generally resulted in the failure of achieving the benefits of the present invention.

In addition to the quaternized heterocyclic brightener and leveling agent, the aqueous zinc plating solution may further advantageously contain secondary or supporting brighteners of the types known in the art, of which linear polyethers having a molecular weight range of about 400 up to about 1,000,000; aryl polyethers of a molecular weight ranging from about 400 up to approximately 5,000; polyglycidols having a molecular weight ranging from about 300 up to about 800, and olefin and acetylenic glycol ethers of a molecular weight ranging from about 100 to approximately 5,000 are particularly satisfactory. Included within the aforementioned group of secondary supporting brighteners which have been found particularly satisfactory are acetylenic glycol 2,3,7,9-tetramethyl 5-decyne-4,7 diol ethoxylated; B-naphthol ethoxylated; phenol ethoxylated; polyglycidol; polyoxyethylene; polyoxypropylene; as well as mixtures thereof. Such supporting brightener agents further enhance the brilliance of the zinc plating deposit and can advantageously be employed in amounts ranging from about 0.25 up to about 20 g/l.

In accordance with the process aspects of the present invention, the zinc electroplating bath is operated within a pH range of about 2.0 to about 9.0 and the acidity is adjusted by the addition of sulfuric acid to the sulfate, sulfate-chloride, and hydrochloric acid to the chloride bath. The bath further preferably incorporates conventional buffering agents to maintain pH control. In those situations in which the plating bath operates at a substantially neutral pH above about 6.8 to about 9.0, suitable organic chelating agents are advantageously employed such as NTA, ETDA, citric acid or the like in amounts conventionally ranging from about 0.5 up to approximately 250 g/l for preventing the zinc metal ions from precipitating from the bath.

The attainment of brilliant, smooth and adherent zinc deposits in accordance with the present invention can be achieved by employing any one of a variety of plating techniques including barrel plating, tank plating, continuous plating and the like. The electroplating bath can be employed at temperatures ranging from about room temperature up to about 140° F. while temperatures of from about 60° F. to about 90° F. are preferred. The electroplating operation can be carried out over a broad range of current densities ranging from about 5 ASF to approximately 20 ASF.

In order to further illustrate the zinc plating bath of the present invention the following specific examples are provided. It will be understood, however, that the examples are provided for illustrative purposes only and are not intended to be restrictive of the present invention as herein described and set forth in the subjoined claims.

EXAMPLE 1

A J-shaped steel test specimen was plated for a period of 30 minutes at a current density of 25 ASF with a bath solution at a pH of 6.3 of the following composition:

| Constituent | Concentration |
|---|---|
| zinc chloride | 60 g/l |
| potassium chloride | 195 g/l |
| boric acid | 30 g/l |
| butyl nicotinate p-methyl tosylate quaternary | 0.1 g/l |

The plated test specimen was provided with a bright smooth adherent zinc electrodeposit.

EXAMPLE 2

A J-shaped steel test specimen was electroplated in a bath at a temperature of 75° F. at a current density of 45 ASF and at a pH of 3.9 for a period of 15 minutes. The bath composition was as follows:

| Constituent | Concentration |
|---|---|
| zinc sulfate | 250 g/l |
| boric acid | 15 g/l |
| magnesium sulfate | 15 g/l |
| polyglycidol (MW 600) | 0.5 g/l |
| nicotinic acid dimethyl sulfate quaternary | 0.075 g/l |

The electroplated test specimen had a bright smooth adherent zinc electrodeposit.

EXAMPLE 3

A J-shaped steel test specimen was electroplated in an aqueous bath at a pH of 4.5 at a current density of 65 ASF for a period of 10 minutes at a temperature of about 85° F. The aqueous plating solution had a composition as follows:

| Constituent | Concentration |
|---|---|
| zinc sulfate | 150 g/l |
| boric acid | 23 g/l |
| nicotinamide diethyl sulfate quaternary | 3 mg/l |

The electroplated test specimen had a bright smooth adherent zinc plate thereover.

EXAMPLE 4

A J-shaped steel test specimen was electroplated in an aqueous solution at a pH of 3.5 for a period of 5 minutes at a temperature of 80° F. and at a current density of 80 ASF. The bath composition was as follows:

| Constituent | Concentration |
|---|---|
| zinc fluoborate | 205 g/l |
| quinaldine dimethyl sulfate quaternary | 5 mg/l |

The electroplated test specimen had a bright smooth adherent zinc plate thereover.

EXAMPLE 5

A J-shaped steel test specimen was electroplated in a bath at a temperature of 72° F., a pH of 5.0, and a current density of 40 ASF. The bath composition was as follows:

| Constituent | Concentration |
|---|---|
| zinc chloride | 75 g/l |
| potassium chloride | 225 g/l |
| boric acid | 25 g/l |
| 2,3,7,9 tetramethyl 5-decyne-4, 7-diol ethoxylated | 5 g/l |
| isoquinoline diethyl sulfate quaternary | 2 mg/l |

The resultant test specimen had a bright smooth adherent zinc plate deposit thereon.

EXAMPLE 6

A J-shaped steel test specimen was electroplated in an aqueous bath solution at a pH of 4.0, at a temperature of 80° F. for a period of 7 minutes at a current density of 60 ASF. The bath composition was as follows:

| Constituent | Concentration |
|---|---|
| zinc sulfate | 200 g/l |
| ammonium sulfate | 25 g/l |
| polyglycidol (MW 400) | 2 g/l |
| quinaldine dimethyl sulfate quaternary | 0.5 g/l |

The plated test specimen had a bright smooth appearance zinc plate thereover.

EXAMPLE 7

A J-shaped steel test specimen was electroplated in a bath at a temperature of 68° F., having a pH of 4.8 for a period of 10 minutes at a current density of 50 ASF. The electroplating bath composition was as follows:

| Constituent | Concentration |
|---|---|
| zinc sulfate | 20 g/l |
| zinc chloride | 30 g/l |
| ammonium chloride | 225 g/l |
| polyoxyethylene (MW 100,000) | 1 g/l |
| propyl isonicotinate dipropyl sulfate quaternary | 0.25 g/l |

The electroplated test specimen had a bright smooth adherent zinc plate thereover.

While it will be apparent that the invention herein disclosed is well calculated to achieve the benefits and advantages as hereinabove set forth, it will be appreciated that the invention is susceptible to modifications, variations and changes without departing from the spirit thereof on the scope of the subjoined claims.

What is claimed is:

1. An aqueous non-cyanide zinc electroplating bath having a pH of from about 2.0 to about 9.0 which electroplating bath contains an effective amount of a brightening and leveling agent comprising a bath soluble nitrogen heterocyclic quaternary having the formula:

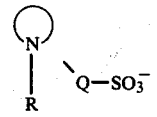

Wherein:

$Q = R_1, R_2O$ $R = CH_3, C_2H_5$ $R_1 = CH_3, C_2H_5, CH_3C_6H_4$ $R_2 = CH_3, C_2H_5$

2. A zinc electroplating bath as defined in claim 1, in which the nitrogen heterocyclic is selected from the group consisting of pyridine, isoquinoline, quinoline, pyrimidine, phenazine, imidazole, imidazoline, pyrrole, pyrazole, pyrazine, purine, acridine, and soluble substituted derivatives of the named compounds and mixtures thereof.

3. A zinc electroplating bath as defined in claim 1, in which the brightening and leveling agent is present in an amount of between about ½ mg/l and 5.0 g/l.

4. A zinc electroplating bath as defined in claim 1, in which the quaternary is selected from the group consisting of isoquinoline diethyl sulfate quaternary, quinaldine diethyl sulfate quaternary, propylisonicotinate dipropyl sulfate quaternary, pyrimidine diethyl sulfate quaternary, phenazine dimethyl sulfate quaternary, pyridine-N-methyl tosylate quaternary, pyridine dimethyl sulfate quaternary, nicotinamide dimethyl sulfate quaternary, and imidazole dimethyl sulfate quaternary.

5. A zinc electroplating bath as defined in claim 1, in which there is further included a secondary brightener selected from the group consisting of acetylenic glycol 2,3,7,9-tetramethyl 5-decyne-4,7 diol ethoxylated; B-naphthol ethoxylated; phenol ethoxylated; polyglycidol; polyoxyethylene; polyoxypropylene; and mixtures thereof.

6. A process for depositing a bright, smooth, adherent zinc plating on a substrate which comprises the steps of electrodepositing zinc from an aqueous non-cyanide zinc electroplating bath as defined in claim 1.

* * * * *